US007278232B2

(12) United States Patent
Kleissler et al.

(10) Patent No.: US 7,278,232 B2
(45) Date of Patent: Oct. 9, 2007

(54) ALBUM PAGE FOR DISPLAYING PLANAR ARTICLES

(75) Inventors: Charles R. Kleissler, Hugo, MN (US); Joseph P. Callahan, Jr., St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 347 days.

(21) Appl. No.: 10/909,553

(22) Filed: Aug. 2, 2004

(65) Prior Publication Data

US 2006/0022450 A1 Feb. 2, 2006

(51) Int. Cl.
*A47G 1/06* (2006.01)

(52) U.S. Cl. ..... 40/777; 40/778

(58) Field of Classification Search ..... 40/777, 40/778

See application file for complete search history.

(56) References Cited

U.S. PATENT DOCUMENTS

| | | | | |
|---|---|---|---|---|
| 2,517,535 | A | 8/1950 | Cross | |
| 3,274,706 | A | 9/1966 | Friend | |
| 3,346,979 | A * | 10/1967 | Milos | 40/778 |
| 3,624,688 | A | 11/1971 | Miller | |
| 4,141,162 | A | 2/1979 | Mascolo | |
| 4,479,318 | A | 10/1984 | Russell | |
| 5,033,215 | A | 7/1991 | Newberry et al. | |
| 5,426,876 | A | 6/1995 | Jagoe et al. | |
| 5,569,503 | A | 10/1996 | Piotroski | |
| 5,826,851 | A | 10/1998 | Arbisi | |
| 5,893,229 | A | 4/1999 | Werner | |
| 5,987,791 | A | 11/1999 | Paine | |
| 6,101,752 | A | 8/2000 | Cumberland | |
| 6,266,907 | B1 | 7/2001 | Matteau et al. | |
| 6,511,245 | B1 | 1/2003 | Tan | |
| 2001/0042328 | A1 | 11/2001 | Matteau et al. | |
| 2002/0067037 | A1 | 6/2002 | Lo | |
| 2002/0106236 | A1 | 8/2002 | Hashizume | |
| 2003/0110672 | A1 | 6/2003 | Tan | |

FOREIGN PATENT DOCUMENTS

| | | | |
|---|---|---|---|
| DE | 3140660 | A1 | 7/1982 |
| DE | 29922367 | U1 | 4/2001 |
| DE | 20109328 | U1 | 8/2001 |
| EP | 63856 | A1 | 11/1982 |
| FR | 2432392 | A1 | 4/1980 |
| GB | 2108047 | A | 5/1983 |

(Continued)

OTHER PUBLICATIONS

U.S. Appl. No. 10/909,728, Kleissler et al.; Device for Supporting a Substantially Planar Article; filed on Aug. 2, 2004.

*Primary Examiner*—Joanne Silbermann
(74) *Attorney, Agent, or Firm*—Trisha D. Adamson

(57) ABSTRACT

A display page assembly for holding substantially planar articles includes a base layer, an anchoring layer, and a protective layer. The anchoring layer is attached to the base layer and includes a plurality of mounting apertures formed therein. The plurality of mounting apertures are arranged for receiving a portion of a substantially planar article therein to secure the substantially planar articles relative to the page. The protective layer is attached relative to the anchoring layer to cover the substantially planar article.

12 Claims, 3 Drawing Sheets

FOREIGN PATENT DOCUMENTS

| | | | |
|---|---|---|---|
| GB | 2198084 | A | 6/1988 |
| JP | 8108672 | A | 4/1996 |
| JP | 11192790 | A | 7/1999 |
| JP | 2000/0253362 | A | 9/2000 |
| JP | 2002/072939 | A | 3/2002 |
| JP | 2002/347377 | A | 12/2002 |
| WO | WO 2004/022357 | A2 | 3/2004 |

* cited by examiner

ALBUM PAGE FOR DISPLAYING PLANAR ARTICLES

BACKGROUND OF THE INVENTION

The present invention relates to an album page. In particular, the present invention relates to an album page for mounting substantially planar articles, such as photographs, on the album page mechanically and without the use of adhesives.

Albums for the display of planar articles, such as photographs, recipe cards, greeting cards, and the like, typically utilize a construction such as a book or a loose-leaf binder with pages on which the planar articles are mounted by various means. A wide variety of pages used to support and display the planar articles are known in the art. These pages use various means to mount the planar articles to the page, such as adhesives, individually applied corner mounts, integrated pockets in which to insert the planar articles, and so on.

For album pages on which an adhesive is used to mount the planar articles on a page, an adhesive substance is typically applied to completely coat a paper or cardboard sheet. When a photograph is placed on the page covered in the adhesive substance, the adhesive substance retains the photographs on the page. A cover sheet is typically also provided to further secure the planar articles to the page and prevent adjacent album pages from adhering to each other. While the use of an adhesive substance provides an acceptable short-term means of attaching photographs to a page, the properties of the adhesive material change over time. This often has a deleterious effect on the integrity of the planar article. For example, when a photograph is exposed to the adhesive substance for an extended period of time, the photo paper may begin to degrade and/or the emulsion chemistry of the photograph may begin to change, resulting in a permanent color change of the photograph. Furthermore, a photograph may become difficult or impossible to remove from the adhesive substance after long-term exposure.

Another means of mounting a planar article is by attaching to the album pages a plurality of triangular-shaped pockets to receive a corner of the planar article. These triangular-shaped pockets are commonly referred to as "photo corners." Photo corners are an alternative to mounting planar objects with an adhesive substance, and the inherent drawbacks of using an adhesive substance are avoided. However, photo corners must be individually purchased and subsequently arranged on an album page to precisely align with the contours of the planar article. This approach is very time-consuming and subject to human error. Furthermore, if the photo corners are made of an opaque or translucent material, the portion of the planar object received by the photo corner will be obscured from view on the album page.

Album pages that include integrated transparent pockets to hold planar articles are also well known in the art. The transparent pockets are typically formed by sealing two sheets of flexible transparent material together at various locations to create pockets or by adhering two sheets of flexible transparent material at various locations to both sides of a piece of paper to create pockets. While the use of integrated transparent pockets to display planar articles avoids many of the drawbacks associated with mounting planar articles with an adhesive substance or with photo corners, the use of integrated transparent pockets also has drawbacks. For example, the pockets are typically formed on the album page to allow for only a particular size or orientation of planar article to be displayed on the page. This prevents a user from displaying planar articles of varying sizes and orientations on the same page. Furthermore, insertion of pictures into integrated transparent pockets can at times be difficult and time-consuming.

Thus, there is a need in the art for an album page assembly that avoids the drawbacks of the various approaches to mounting planar articles heretofore described.

BRIEF SUMMARY OF THE INVENTION

The present invention is a display page assembly for holding substantially planar articles. The display page assembly includes a base layer, an anchoring layer, and a protective layer. The anchoring layer is attached to the base layer and includes a plurality of mounting apertures formed therein. The plurality of mounting apertures are arranged for receiving a portion of a substantially planar article therein to secure the substantially planar articles relative to the page. The protective layer is attached relative to the anchoring layer to cover the substantially planar article.

In one embodiment, the plurality of mounting apertures is arranged on the anchoring layer to secure a plurality of substantially planar articles on the anchoring layer. The plurality of mounting apertures is arranged on the anchoring layer such that substantially planar articles of varying sizes and orientations are securable on the anchoring layer.

In another embodiment, the plurality of mounting apertures comprises a slit. Each slit is aligned to receive a portion of a corner of a substantially planar article. Each slit may also include means for raising a portion of the anchoring layer adjacent each slit to facilitate insertion of a portion of the corner of the substantially planar article into the slit. In another embodiment, the plurality of mounting apertures defines a plurality of tabs, each tab aligned for receiving a portion of an edge of a substantially planar article.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principals of this invention. The figures may not be drawn to scale. Like reference numbers have been used throughout the figures to denote like parts.

DETAILED DESCRIPTION

Figure 1A:
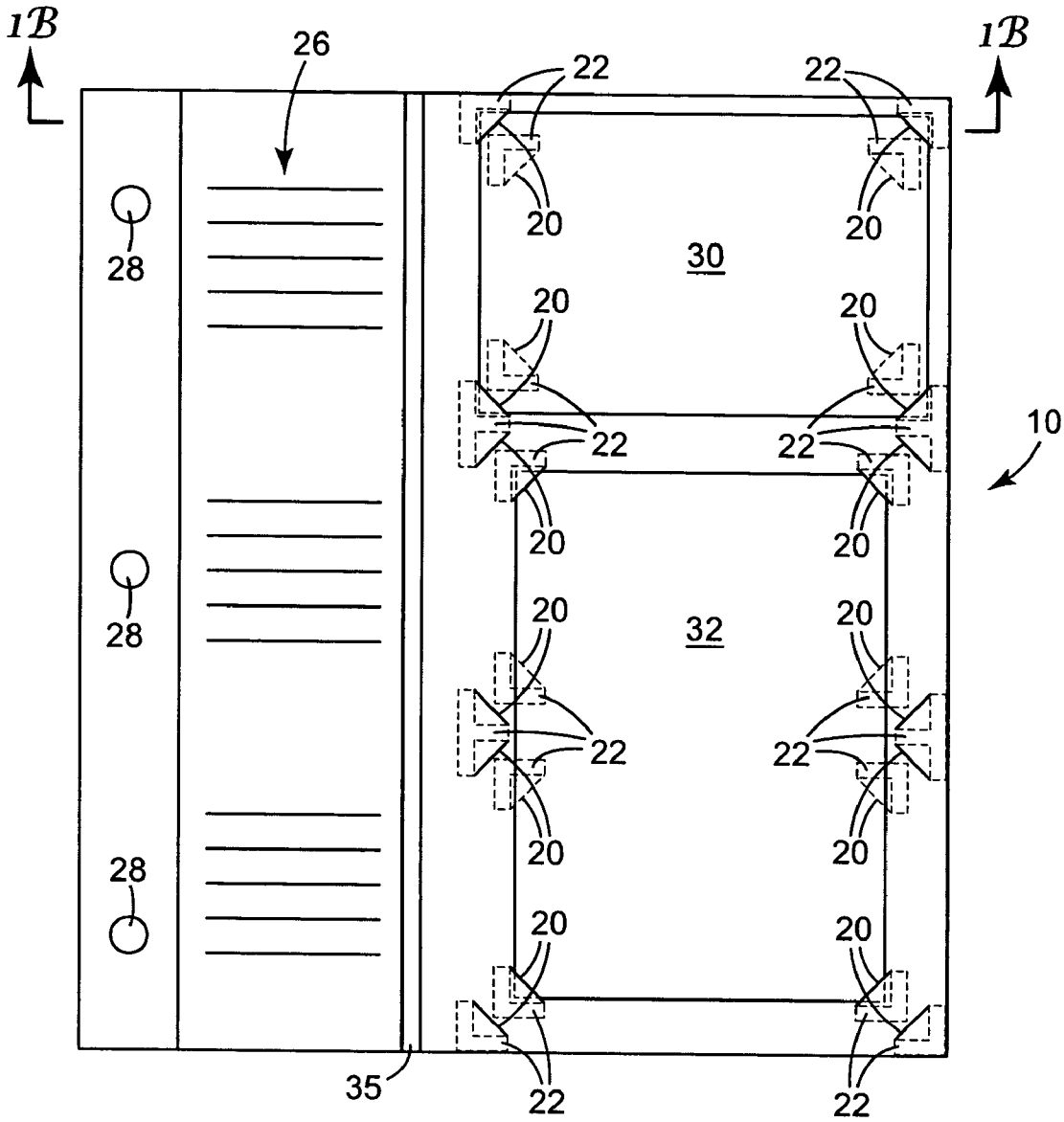
FIG. 1A is a front view of an album page according to the present invention including corner slits to retain planar objects on the album page.
Figure 1B:
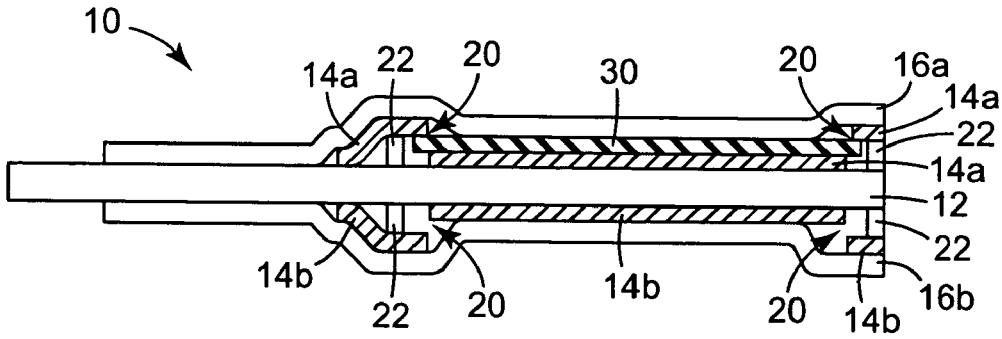
FIG. 1B is a sectional view along lines 1B-1B in FIG. 1A.

FIG. 1A is a front view and FIG. 1B is a sectional view (along lines 1B-1B in FIG. 1A) of album page 10 according to the present invention. Album page 10 includes base layer 12, first and second mounting or anchoring layers 14*a* and 14*b*, and first and second protective layers 16*a* and 16*b*. Mounting layers 14*a* and 14*b* are attached to base layer 12, and protective layers 16*a* and 16*b* are positioned adjacent to mounting layers 14*a* and 14*b*, respectively. Corner slits 20 are formed in each of mounting layers 14*a* and 14*b*, and a corner retainer 22 is positioned adjacent to each corner slit 20. Album page 10 also includes journaling area 26 on each side thereof. Holes 28 are provided on a side of album page 10 for inserting album page 10 into a ring binder or the like. The thicknesses of the various layers of album page 10 are exaggerated in FIG. 1B to show the connectivity of and the relationships between the various layers.

Planar articles are mounted on album page 10, and in particular on mounting layers 14*a* and 14*b*. Planar articles 30 and 32 are shown in FIG. 1A to depict an optional display configuration for planar articles mounted on mounting layer 14*a*. Planar articles 30 and 32 are typically photographs, but any planar articles are mountable on album page 10 for display, such as recipe cards, greeting cards, announcements, art work, index cards, and the like. In the embodiment shown in FIGS. 1A and 1B, planar articles 30 and 32 are mounted on album page 10 by inserting corners of planar articles 30 and 32 into corner slits 20. Corner slits 20 receive the corners of planar articles 30 and 32 such that the corners of planar articles 30 and 32 are positioned under mounting layer 14*a* and over base layer 12 when properly mounted on mounting layer 14*a*. When the corners of planar articles 30 and 32 are received by corner slits 20, planar articles 30 and 32 are prevented from moving with respect to album page 10.

In order to facilitate insertion of the corners of planar articles 30 and 32 into corner slits 20, corner retainers 22 are preferably provided. A corner retainer 22 is positioned adjacent to each corner slit 20 between base layer 12 and mounting layers 14*a* and 14*b*. Corner retainers 22 are preferably made of the same or similar material as base layer 12 and raise a portion of corner slits 20 such that corners of planar articles 30 and 32 are easily insertable between mounting layers 14*a* and 14*b* and base layer 12. In particular, corner retainers 22 permit insertion of the corners of planar articles 30 and 32 without the need to manually separate mounting layer 14*a* or 14*b* from base layer 12.

Base layer 12 is made of a resilient material which provides a robust foundation for album page 10. In a preferred embodiment, base layer 12 is made of an opaque fibrous material such as paper. The paper used for base layer 12 is preferably a paper having a weight typical of that used in the photo album or scrapbook art (e.g., greater than 10 pounds per 1,000 square feet). While the use of paper for base layer 12 is preferred, various alternative materials may also be used. For example, base layer 12 may be made of a translucent or a transparent resilient material, such as a polymer based material, to allow viewing of planar articles mounted on the opposing side of album page 10.

Mounting layers 14*a* and 14*b* are preferably attached to base layer 12 with an adhesive material, such as a pressure sensitive adhesive. The adhesive is applied to cover both major surfaces of base layer 12 except in journaling area 26 and in the area surrounding corner slits 20. The adhesive is not applied to the area surrounding corner slits 20 to allow insertion the corners of planar articles 30 and 32 into corner slits 20 (i.e., between base layer 12 and mounting layer 14*a*).

Mounting layers 14*a* and 14*b* are made of a material that is pliable to permit the corners of planar articles 30 and 32 to be easily received by corner slits 20, but durable to allow frequent insertion into corner slits 20 and removal from corner slits 20 of planar articles 30 and 32 without damage to the corner slits 20. In a preferred embodiment, mounting layers 14*a* and 14*b* are made of transparent polymeric material, such as polypropylene, polyethylene, a polyester, a polyamide, an ionomer, or the like. The use of a transparent material for mounting layers 14*a* and 14*b* allows viewing of the corners of planar articles 30 and 32 through mounting layer 14*a* when received by corner slits 20.

Corner slits 20 are typically formed in mounting layers 14*a* and 14*b* by die cutting, and preferably have a length in the range of 0.50 and 1.00 inch and a width of less than 0.25 inch. The pattern of corner slits 20 shown in FIG. 1A is merely illustrative, and any alternative pattern of corner slits may be formed in mounting layers 14*a* and 14*b* instead of or in addition to the pattern shown to mount planar articles of varying sizes and orientations on album page 10. For example, corner slits may be formed in mounting layers 14*a* and 14*b* in a pattern to allow mounting of photographs of standard sizes (e.g., wallet, 3½"×5", 4"×6", 5"×7", etc.) in varying orientations. Furthermore, corner slits may be formed in mounting layers 14*a* and 14*b* in a customized pattern to allow mounting of planar objects of unique sizes in varying orientations. Finally, corner slits may be formed in mounting layers 14*a* and 14*b* to allow mounting a combination of standard and unique sized planar objects in varying orientations on album page 10.

Protective layers 16*a* and 16*b* are positioned relative to mounting layers 14*a* and 14*b*, respectively, to cover the planar articles. Protective layers 16*a* and 16*b* are preferably made of transparent polymeric material, such as polypropylene, polyethylene, a polyester, a polyamide, an ionomer, or the like. Most preferably, protective layers 16*a* and 16*b* are made of a partially-neutralized ethylene methacrylic copolymer ionomer, sold by E.I. DuPont de Nemours Co., Wilmington, Del., under the trade designation Surlyn. Furthermore, protective layers 16*a* and 16*b* are preferably electrostatically charged so as to cling to the layer directly adjacent to it. In this way, protective layer 16*a* not only protects planar articles 30 and 32 and journaling area 26 from dust, smudging, and other elements, but also further secures the planar articles to album page 10.

Protective layers 16*a* and 16*b* are preferably attached or bonded to mounting layers 14*a* and 14*b*, respectively, and/or base layer 12 along region 35. This allows protective layers 16*a* and 16*b* to be removably positioned over planar objects 30 and 32. Alternatively, protective layers 16*a* and 16*b* may be secured (to base layer 12, for example) between journaling area 26 and holes 28, or along the edge of album page 10 opposite of holes 28 to be removably positioned over planar objects 30 and 32 and over journaling area 26. In an embodiment where protective layers 16*a* and 16*b* are secured to base layer 12, they are attached to each other with an adhesive material. In an embodiment where protective layers 16*a* and 16*b* are secured to mounting layers 14*a* and 14*b*, respectively, they are attached to each other with an adhesive material or by heat bonding means such as ultrasonic welding or thermal bonding.

Journaling area 26 is preferably printed on base layer 12, but may also be provided as a separate layer of material attached to base layer 12. Journaling area 26 allows recording of information regarding the planar articles displayed on album page 10, such as the subject matter of the planar articles displayed. Preferably, a portion of protective layers 16*a* and 16*b* covers journaling area 26 to prevent smudging or distorting of information recorded in journaling area 26. However, journaling area 26 may also remain uncovered by protective layers 16*a* and 16*b*. Alternatively, journaling area 26 may be omitted, and mounting layers 14*a* and 14*b* may be extended to holes 28 (and additional corner slits 20 formed therein) to allow mounting of further planar articles on album page 10.

Several optional modifications may be made to album page 10 as described without departing from the spirit and scope of the present invention. For example, a mounting layer and a protective layer may be attached to a single side of base layer 12 (that is, planar objects may be mounted in corner slits on a single side of base layer 12), leaving the other side of base layer 12 available for other uses, such as for mounting of other articles using adhesive means or for additional space for notes. Also, a frame or other decorative pattern may be printed on base layer 12 to give the planar articles mounted on mounting layer 14*a* or 14*b* a framed or decorative appearance (when base layer 12 is viewed through mounting layer 14*a* or 14*b*). Furthermore, base layer 12 may be omitted from album page 10 such that planar objects are secured on album page 10 by inserting corners of the planar objects between mounting layers 14*a* and 14*b*.

Figure 2A:
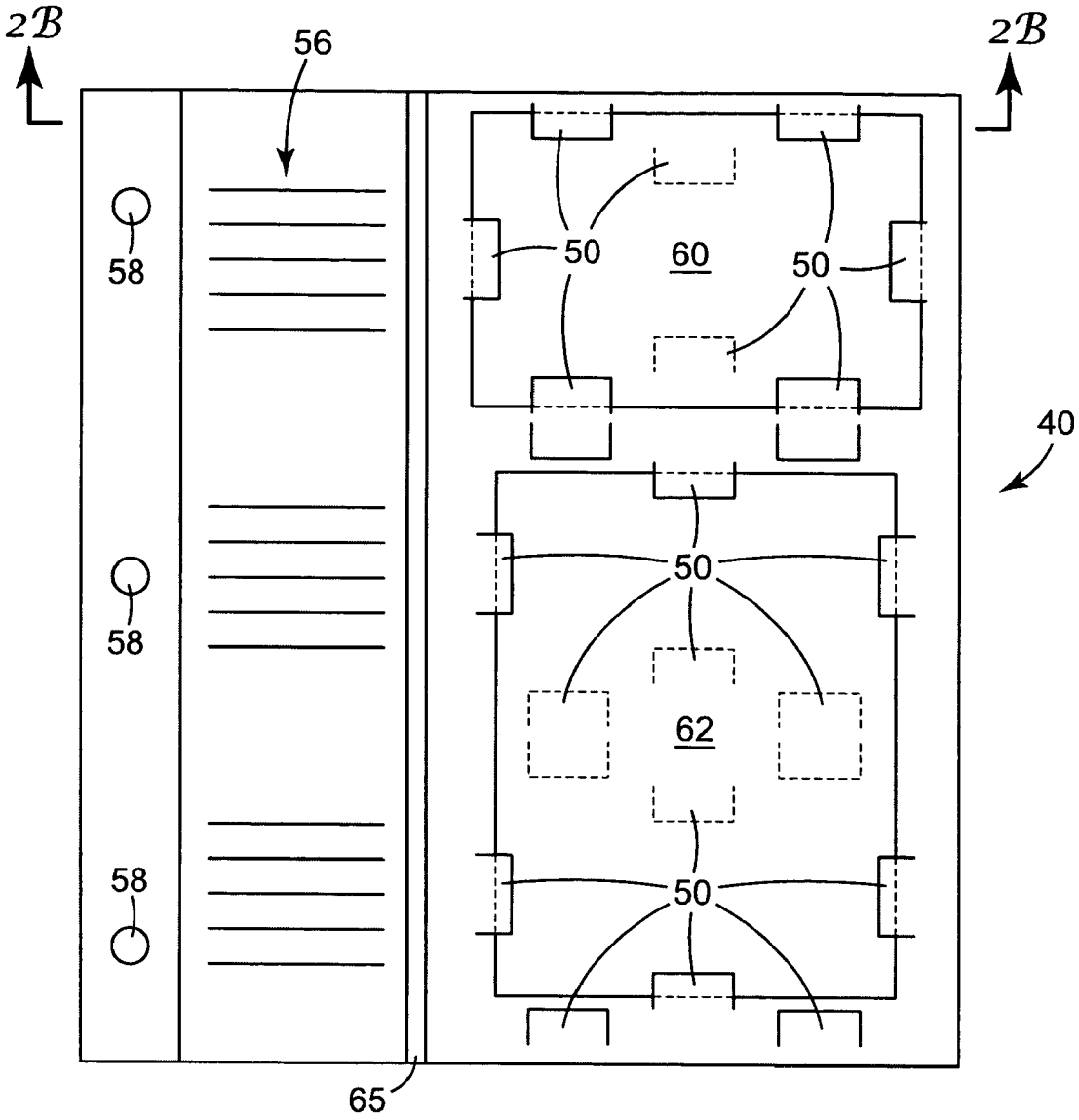
FIG. 2A is a front view of an album page according to the present invention including edge tabs to retain planar objects on the album page.
Figure 2B:
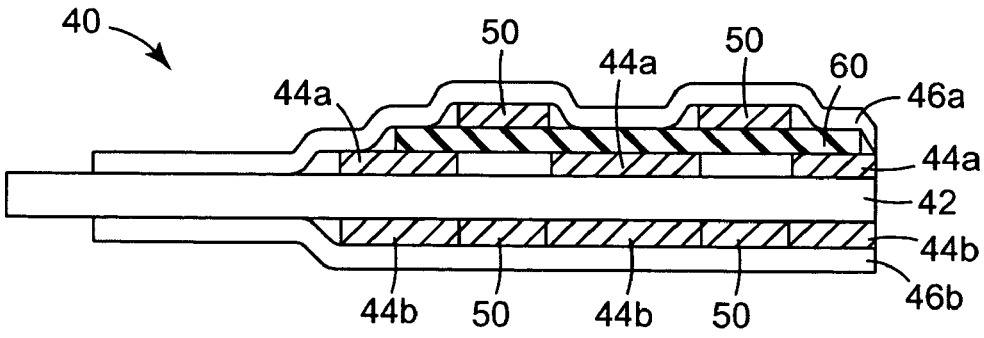
FIG. 2B is a sectional view along lines 2B-2B in FIG. 2A.

FIG. 2A is a front view and FIG. 2B is a sectional view (along lines 2B-2B in FIG. 2A) of album page 40 according to the present invention. Album page 40 includes base layer 42, first and second mounting or anchoring layers 44*a* and 44*b*, and first and second protective layers 46*a* and 46*b*. Mounting layers 44*a* and 44*b* are attached to base layer 42, and protective layers 46*a* and 46*b* are positioned adjacent to mounting layers 44*a* and 44*b*, respectively. Edge tabs 50 are formed in each of mounting layers 44*a* and 44*b*. Album page 40 also includes journaling area 56 on each side thereof. Holes 58 are provided on a side of album page 40 for inserting album page 40 into a ring binder or the like. The thicknesses of the various layers of album page 40 are exaggerated in FIG. 2B to show the connectivity of and the relationships between the various layers.

Planar articles are mounted on album page 40, and in particular on mounting layers 44*a* and 44*b*. Planar articles 60 and 62 are shown in FIG. 2A to depict an optional display configuration for planar articles mounted on mounting layer 44*a*. Planar articles 60 and 62 are typically photographs, but any planar articles are mountable on album page 40 for display, such as recipe cards, greeting cards, announcements, art work, index cards, and the like. In the embodiment shown in FIGS. 2A and 2B, planar articles 60 and 62 are mounted on album page 40 by inserting edge portions of planar articles 60 and 62 under edge tabs 50. Edge tabs 50 receive the edge portions of planar articles 60 and 62 such that the edge portions of planar articles 60 and 62 are positioned under mounting layer 44*a* and over base layer 42 when properly mounted on mounting layer 44*a*. When the edge portions of planar articles 60 and 62 are received by edge tabs 50, planar articles 60 and 62 are prevented from moving with respect to album page 40.

Base layer 42 is made of a resilient material which provides a robust foundation for album page 40. In a preferred embodiment, base layer 42 is made of an opaque fibrous material such as paper. The paper used for base layer 42 is preferably a paper having a weight typical of that used in the photo album or scrapbook art (e.g., greater than 10 pounds per 1,000 square feet). While the use of paper for base layer 42 is preferred, various alternative materials may also be used. For example, base layer 42 may be made of a translucent or a transparent resilient material, such as a polymer based material, to allow viewing of planar articles mounted on the opposing side of album page 40.

Mounting layers 44*a* and 44*b* are preferably attached to base layer 42 with an adhesive material, such as a pressure sensitive adhesive. The adhesive is applied to cover both major surfaces of base layer 42 except in journaling area 56 and in the area surrounding edge tabs 50. The adhesive is not applied to the area surrounding edge tabs 50 to allow the edge tabs to be lifted for insertion of edge portions of planar articles 60 and 62 under edge tabs 50 (i.e., between base layer 42 and mounting layer 44*a*).

Mounting layers 44*a* and 44*b* are made of a material that is pliable to permit the edge portions of planar articles 60 and 62 to be easily received by edge tabs 50, but durable to allow for frequent insertion into edge tabs 60 and removal from edge tabs 60 of planar articles 60 and 62 without damage to the tabs. In a preferred embodiment, mounting layers 44*a* and 44*b* are made of transparent polymeric material, such as polypropylene, polyethylene, a polyester, a polyamide, an ionomer, or the like. The use of a transparent material for mounting layer 44 allows viewing of the edge portions of planar articles 60 and 62 positioned under edge tabs 50.

Edge tabs 50 are typically formed in mounting layers 44*a* and 44*b* by die cutting three sides of a quadrilateral shape into mounting layers 44*a* and 44*b*. The fourth, uncut side of the quadrilateral provides the pivot point for lifting edge tabs 50. The pattern of edge tabs 50 shown in FIG. 2A is merely illustrative, and any alternative pattern of edge tabs may be formed in mounting layers 44*a* and 44*b* instead of or in addition to the pattern shown to mount planar articles of varying size and orientation on album page 40. For example, edge tabs may be formed in mounting layers 44*a* and 44*b* in a pattern to allow mounting of photographs of standard sizes (e.g., wallet, 3½"×5", 4"×6", 5"×7", etc.) in varying orientations. Furthermore, edge tabs may be formed in mounting layers 44*a* and 44*b* in a customized pattern to allow mounting of planar objects of unique sizes in varying orientations. Finally, edge tabs may be formed in mounting layers 44*a* and 44*b* to allow mounting a combination of standard and unique sized planar articles in varying orientations on album page 40.

Protective layers 46*a* and 46*b* are positioned relative to mounting layers 44*a* and 44*b* to cover the planar articles. Protective layers 46*a* and 46*b* are preferably made of transparent polymeric material, such as polypropylene, polyethylene, a polyester, a polyamide, an ionomer, or the like. Most preferably, protective layers 46*a* and 46*b* are made of a partially-neutralized ethylene methacrylic copolymer ionomer film, commonly known as Surlyn. Furthermore, protective layers 46*a* and 46*b* are preferably electrostatically charged so as to cling to the layer directly adjacent to it. In this way, protective layer 46*a* not only protects planar articles 60 and 62 and journaling area 56 from dust, smudging, and other elements, but also further secures the planar articles to album page 40.

Protective layers 46*a* and 46*b* are preferably attached or bonded to mounting layers 44*a* and 44*b*, respectively, and/or base layer 42 along region 65. This allows protective layers 46*a* and 46*b* to be removably positioned over planar objects 60 and 62. Alternatively, protective layers 46*a* and 46*b* may be secured (to base layer 42, for example) between journaling area 56 and holes 58, or along the edge of album page 40 opposite of holes 58 to be removable positioned over planar objects 60 and 62 and over journaling area 56. In an embodiment where protective layers 46*a* and 46*b* are secured to base layer 42, they are attached to each other with an adhesive material. In an embodiment where protective layers 46*a* and 46*b* are secured to mounting layers 44*a* and 44*b*, respectively, they are attached to each other with an adhesive material or by heat bonding means such as ultrasonic welding or thermal bonding.

Journaling area 56 is preferably printed on base layer 42, but may also be provided as a separate layer of material attached to base layer 42. Journaling area 56 allows recording of information regarding the planar articles displayed on album page 40, such as the subject matter of the planar articles displayed. Preferably, a portion of protective layers 46*a* and 46*b* covers journaling area 56 to prevent smudging or distorting of information recorded in journaling area 56. Journaling area 56 may also not be covered by protective layers 46*a* and 46*b*. Alternatively, journaling area 56 may be omitted, and mounting layer 44 may be extended to holes 58 (and additional edge tabs 50 formed therein) to allow mounting of further planar articles on album page 40.

Several optional modifications may be made to album page 40 as described without departing from the spirit and scope of the present invention. For example, a mounting layer and a protective layer may be attached to a single side of base layer 42 (that is, planar objects may optionally be mounted in edge tabs on a single side of base layer 42), leaving the other side of base layer 42 available for other uses, such as for mounting of other articles using adhesive means or for additional space for notes. Also, a frame or other decorative pattern may be printed on base layer 42 to give the planar articles mounted on mounting layer 44*a* or 44*b* a framed or decorative appearance (when base layer 42 is viewed through mounting layer 44*a* or 44*b*). Furthermore, base layer 42 may be omitted from album page 40 such that planar objects are secured on album page 40 by inserting edge portions of the planar objects under the edge tabs 50 and between mounting layers 44*a* and 44*b*.

Figure 3A:
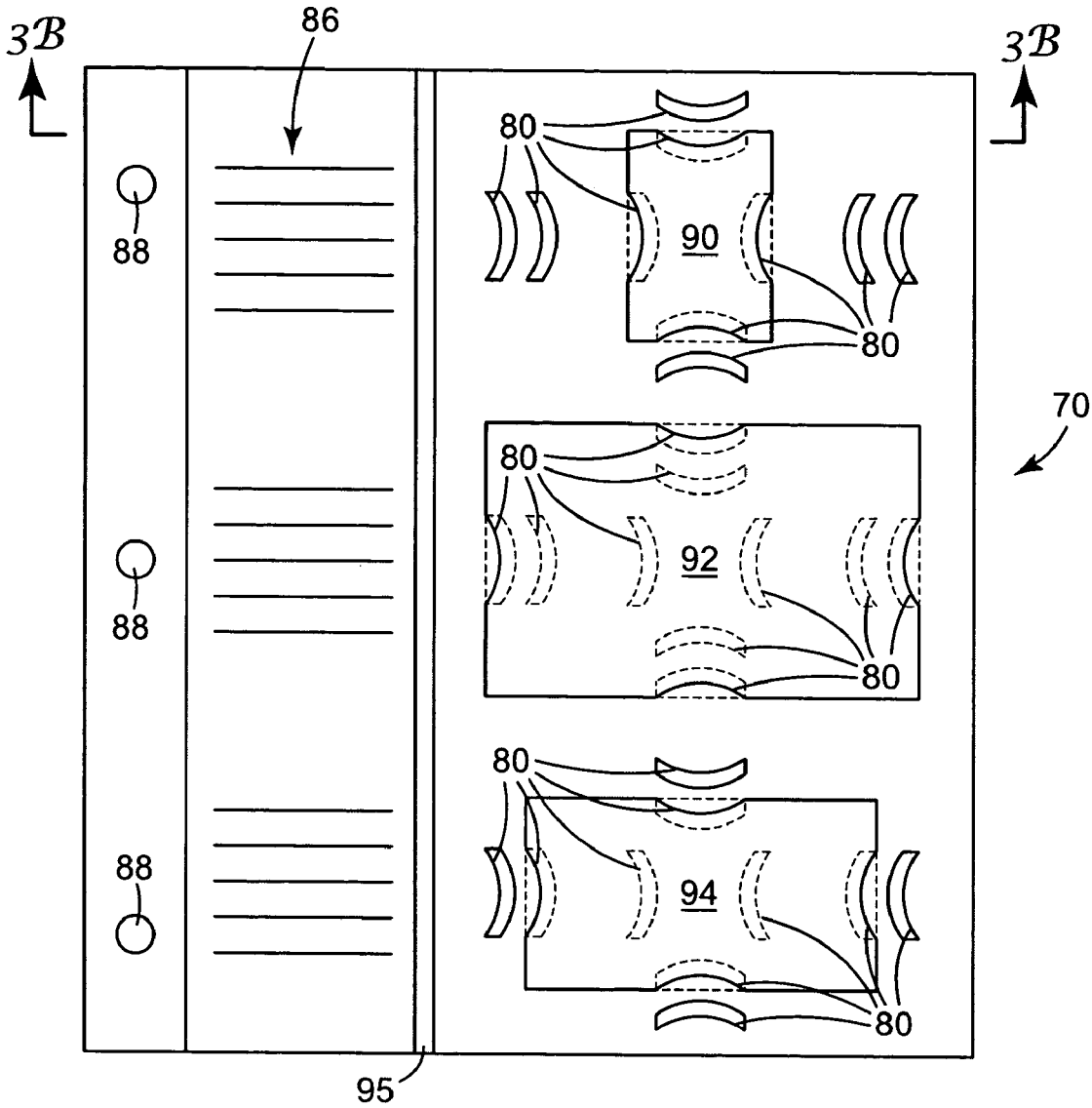
FIG. 3A is a front view of an album page according to the present invention including rounded edge tabs to retain planar objects on the album page.
Figure 3B:
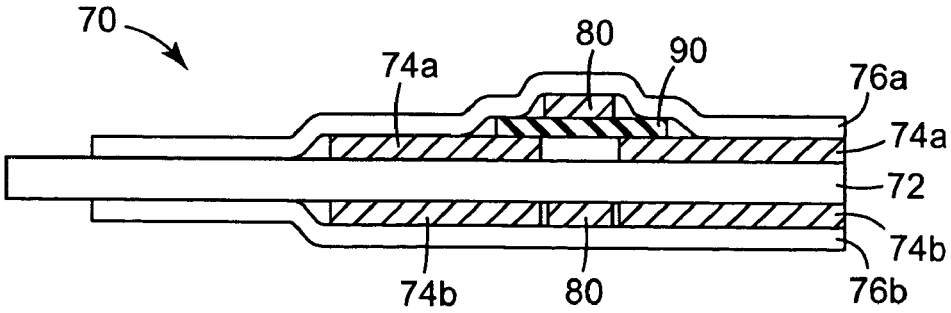
FIG. 3B is a sectional view along lines 3B-3B in FIG. 3A.

FIG. 3A is a front view and FIG. 3B is a sectional view (along lines 3B-3B in FIG. 3A) of album page 70 according to the present invention. Album page 70 includes base layer 72, first and second mounting or anchoring layers 74*a* and 74*b*, and first and second protective layers 76*a* and 76*b*. Mounting layers 74*a* and 74*b* are attached to base layer 72, and protective layers 76*a* and 76*b* are positioned adjacent to mounting layers 74*a* and 74*b*, respectively. Rounded edge tabs 80 are formed in each of mounting layers 74*a* and 74*b*. Album page 70 also includes journaling area 86 on each side thereof. Holes 88 are provided on a side of album page 70 for inserting album page 70 into a ring binder or the like. The thicknesses of the various layers of album page 70 are exaggerated in FIG. 3B to show the connectivity of and the relationships between the various layers.

Planar articles are mounted on album page 70, and in particular on mounting layers 74*a* and 74*b*. Planar articles 90, 92, and 94 are shown in FIG. 3A to depict an optional display configuration for planar articles mounted on mounting layer 74*a*. Planar articles 90, 92, and 94 are typically photographs, but any planar articles are mountable on album page 70 for display, such as recipe cards, greeting cards, announcements, art work, index cards, and the like. In the embodiment shown in FIGS. 3A and 3B, planar articles 90, 92, and 94 are mounted on album page 70 by inserting edge portions of planar articles 90, 92, and 94 under rounded edge tabs 80. Rounded edge tabs 80 receive the edge portions of planar articles 90, 92, and 94 such that the edge portions of planar articles 90, 92, and 94 are positioned between mounting layer 74*a* and base layer 72 when properly mounted on mounting layer 74*a*. When the edge portions of planar articles 90, 92, and 94 are received by rounded edge tabs 80, planar articles 90, 92, and 94 are prevented from moving with respect to album page 70.

Base layer 72 is made of a resilient material which provides a robust foundation for album page 70. In a preferred embodiment, base layer 72 is made of an opaque fibrous material such as paper. The paper used for base layer 72 is preferably a paper having a weight typical of that used in the photo album or scrapbook art (e.g., greater than 10 pounds per 1,000 square feet). While the use of paper for base layer 72 is preferred, various alternative materials may also be used. For example, base layer 72 may be made of a translucent or a transparent resilient material, such as a polymer based material, to allow viewing of planar articles mounted on the opposing side of album page 70.

Mounting layers 74*a* and 74*b* are preferably attached to base layer 72 with an adhesive material, such as a pressure sensitive adhesive. The adhesive is applied to cover both major surfaces of base layer 72 except in journaling area 86 and in the area surrounding rounded edge tabs 80. The adhesive is not applied to the area surrounding rounded edge tabs 80 to allow rounded edge tabs 80 to be lifted for insertion of edge portions of planar articles 90, 92, and 94 under rounded edge tabs 80 (i.e., between base layer 72 and mounting layer 74*a*).

Mounting layers 74*a* and 74*b* are made of a material that is pliable to permit the edges of planar articles 90, 92, and 94 to be easily received by rounded edge tabs 80, but durable to allow for frequent insertion and removal of planar articles 90, 92, and 94 from rounded edge tabs 80 without damage to the tabs. In a preferred embodiment, mounting layers 74*a* and 74*b* are made of transparent polymeric material, such as polypropylene, polyethylene, a polyester, a polyamide, an ionomer, or the like. The use of a transparent material for mounting layers 74*a* and 74*b* allows viewing of the edges of planar articles 90, 92, and 94 through mounting layer 74*a* when received by rounded edge tabs 80.

Rounded edge tabs 80 are typically formed in mounting layers 74*a* and 74*b* by die cutting crescent-shaped slits into mounting layers 74*a* and 74*b*. The portions of mounting layers 74*a* and 74*b* along the inner arc of the crescent-shaped slits comprise rounded edge tabs 80. The pattern of rounded edge tabs 80 shown in FIG. 3A is merely illustrative, and any alternative pattern of rounded edge tabs may be formed in mounting layers 74*a* and 74*b* instead of or in addition to the pattern shown to mount planar articles of varying size and orientation on album page 70. For example, rounded edge tabs may be formed in mounting layers 74*a* and 74*b* in a pattern to allow mounting of photographs of standard sizes (e.g., wallet, 3"×5", 4"×6", 5"×7", etc.) in varying orientations. Furthermore, rounded edge tabs may be formed in mounting layers 74*a* and 74*b* in a customized pattern to allow mounting of planar objects of unique sizes in varying orientations. Finally, rounded edge tabs may be formed in mounting layer 74*a* and 74*b* to allow mounting a combination of standard and unique sized planar objects in varying orientations on album page 70.

Protective layers 76*a* and 76*b* are positioned relative to mounting layers 74*a* and 74*b*, respectively, to cover the planar articles. Protective layers 76*a* and 76*b* are preferably made of transparent polymeric material, such as polypropylene, polyethylene, a polyester, a polyamide, an ionomer, or the like. Most preferably, protective layers 76*a* and 76*b* are made of a partially-neutralized ethylene methacrylic copolymer ionomer, commonly known as Surlyn. Furthermore, protective layers 76*a* and 76*b* are preferably electrostatically charged so as to cling to the layer directly adjacent to it. In this way, protective layer 76*a* not only protects planar articles 90, 92, and 94 and journaling area 86 from dust, smudging, and other elements, but also further secures the planar articles to album page 70.

Protective layers 76*a* and 76*b* are preferably attached or bonded to mounting layer 74*a* and 74*b*, respectively, and/or base layer 72 along region 95. This allows protective layer 76*a* to be removably positioned over planar objects 90, 92, and 94. Alternatively, protective layers 76*a* and 76*b* may be secured between journaling area 86 and holes 88, or along the edge of album page 70 opposite of holes 88 to be removably positioned over planar objects 90, 92, and 94 and over journaling area 86. In an embodiment where protective layers 76*a* and 76*b* are secured to base layer 72, they are attached to each other with an adhesive material. In an embodiment where protective layers 76*a* and 76*b* are secured to mounting layers 74*a* and 74*b*, respectively, they are attached to each other with an adhesive material or by heat bonding means such as ultrasonic welding or thermal bonding.

Journaling area 86 is preferably printed on base layer 72, but may also be provided as a separate layer of material attached to base layer 72. Journaling area 86 allows recording of information regarding the planar articles displayed on album page 70, such as the subject matter of the planar articles displayed. Preferably, a portion of protective layers 76*a* and 76*b* covers journaling area 86 to prevent smudging or distorting of information recorded in journaling area 86. Alternatively, journaling area 86 may be omitted, and mounting layers 74*a* and 74*b* may be extended to holes 88 (and additional rounded edge tabs 80 formed therein) to allow mounting of further planar articles on album page 70.

Several optional modifications may be made to album page 70 as described without departing from the spirit and scope of the present invention. For example, a mounting layer and a protective layer may be attached to a single side of base layer 72 (that is, planar objects may be mounted in rounded edge tabs on a single side of base layer 72), leaving the other side of base layer 72 available for other uses, such as for mounting of other articles using adhesive means or for additional space for notes. Also, a frame or other decorative pattern may be printed on base layer 72 to give the planar articles mounted on mounting layer 74*a* or 74*b* a framed or decorative appearance (when base layer 72 is viewed through mounting layer 74*a* or 74*b*). Furthermore, base layer 72 may be omitted from album page 70 such that planar objects are secured on album page 70 by inserting edges of the planar objects between mounting layers 74*a* and 74*b*.

In summary, conventional album pages use various means to mount planar articles, such as photographs, to the page, such as adhesives, individually applied corner mounts, and integrated pockets in which to insert the planar articles. These various mounting means suffer from a variety of drawbacks that may have a deleterious effect on the integrity of the planar articles and may result in difficulty using the album pages. The present invention is a display page assembly for holding substantially planar articles that avoids these drawbacks. The display page assembly includes a base layer, an anchoring layer, and a protective layer. The anchoring layer is attached to the base layer and includes a plurality of mounting apertures formed therein. The plurality of mounting apertures are arranged for receiving a portion of a substantially planar article therein to secure the substantially planar articles relative to the page. The protective layer is attached relative to the anchoring layer to cover the substantially planar article. The plurality of mounting apertures is preferably arranged on the anchoring layer to secure a plurality of substantially planar articles on the anchoring layer. The plurality of mounting apertures is arranged on the anchoring layer such that substantially planar articles of varying sizes and orientations are securable on the anchoring layer.

Although the present invention has been described with reference to preferred embodiments, workers skilled in the art will recognize that changes may be made in form and detail without departing from the spirit and scope of the invention.

What is claimed is:

1. A display page assembly for holding substantially planar articles comprising:

a base layer;

an anchoring layer attached to the base layer and including a plurality of mounting apertures formed in the anchoring layer, the mounting aperture comprising a slit through the anchoring layer and a retainer for raising a portion of the anchoring layer adjacent each slit, the plurality of mounting apertures arranged for receiving a portion of a substantially planar article therein to secure the substantially planar articles relative to the page; and a protective layer attached relative to the anchoring layer to cover the substantially planar article.

2. The display page assembly of claim 1, wherein the plurality of mounting apertures are arranged on the anchoring layer to secure a plurality of substantially planar articles on the anchoring layer.

3. The display page assembly of claim 2, wherein the plurality of mounting apertures are arranged on the anchoring layer to secure a plurality of substantially planar articles of varying sizes and orientations on the anchoring layer.

4. The display page assembly of claim 1, wherein each slit is aligned to receive a portion of a corner of the substantially planar article.

5. The display page assembly of claim 1, wherein the anchoring layer is transparent to allow viewing of the portion of the substantially planar article received by the mounting apertures.

6. The display page assembly of claim 1, wherein the anchoring layer is attached to the base layer with an adhesive material.

7. The display page assembly of claim 1, wherein the anchoring layer comprises a transparent polymeric material.

8. The display page assembly of claim 7, wherein the transparent polymeric material comprises polypropylene.

9. The display page assembly of claim 1, wherein the protective layer is an electrostatically charged polymeric film.

10. The display page assembly of claim 1, wherein the protective layer is attached to the anchoring layer with an adhesive material.

11. The display page assembly of claim 1, wherein the protective layer is attached to the anchoring layer by heat sealing the protective layer to the anchoring layer.

12. The display page assembly of claim 1, wherein the base layer comprises a resilient material.

* * * * *